United States Patent [19]

Hurwitz et al.

[11] 4,053,660

[45] Oct. 11, 1977

[54] LOW COST TRANSFER INK COATING

[75] Inventors: Harold S. Hurwitz, Downers Grove; Harold E. Dyas, Hillside, both of Ill.

[73] Assignee: Bell & Howell Company, Chicago, Ill.

[21] Appl. No.: 639,524

[22] Filed: Dec. 10, 1975

[51] Int. Cl.[2] ..... B41M 5/10

[52] U.S. Cl. ..... 427/153; 427/144; 427/146; 428/488; 428/914

[58] Field of Search ..... 428/219, 411, 484, 488, 428/913, 914; 427/144, 146, 153; 282/27.5; 197/172

[56] References Cited

U.S. PATENT DOCUMENTS

| | | | |
|---|---|---|---|
| 3,031,327 | 4/1962 | Newman | 427/152 X |
| 3,080,954 | 3/1963 | Newman et al. | 427/146 X |
| 3,337,361 | 8/1967 | La Count | 427/146 |
| 3,458,339 | 7/1969 | Newman | 428/914 X |
| 3,774,539 | 11/1973 | Miyazawa et al. | 427/144 |

*Primary Examiner*—Thomas J. Herbert, Jr.
*Assistant Examiner*—Bruce H. Hess
*Attorney, Agent, or Firm*—Robert A. Walsh

[57] ABSTRACT

A low cost transfer ink coating, comprising a polyhydroxy alcohol, a non-drying oil, a wax, a kaoline-type clay, and a dye, for use on a transfer sheet which is used in making master sheets for the printing of multiple copies therefrom and a method of making such transfer ink coating.

2 Claims, 2 Drawing Figures

LOW COST TRANSFER INK COATING

BACKGROUND OF THE INVENTION

The present invention relates generally to ink coatings for use in the production of multiple copies from a single original or master. More particularly, the present invention concerns a low-cost transfer ink coating for use on transfer sheets used in the production of pressure transferable master sheets from which a multiplicity of high-quality copies may be printed.

Various techniques heretofore have been used in the production of multiple copies from a single original or master. Perhaps the best known example of such prior art techniques is the use of sheets of conventional carbon paper between the ribbon copy and one or more carbon copies in a typewriter. The fact that no master is used in the carbon paper technique limits the number of prints obtainable by such technique to the number of carbon paper-carbon copy layers which may be physically stacked together and accommodated in a typewriter carriage.

In addition, carbon paper is often messy to use and difficult to align for multiple carbon copies. The number of legible, clear copies resulting therefrom is further limited by the impact pressure of the tyewriter key striking the ribbon copy and the diminishing thereof by each subsequent layer of the carbon paper-carbon copy in a layered stack. The lower copies in a stack of multiple layers of carbon paper-carbon copy are poor in quality and relatively non-permanent. Accordingly, only a relatively few carbon copies of any legibility or usefulness may be produced by the carbon paper technique.

Furthermore, carbon paper techniques are less than satisfactory for non-typewriter applications, where large or oddly shaped print images are frequently required. Plainly, conventional carbon paper techniques would be quite unsatisfactory for use in areas such as the production of patterns for making dresses, suits, shirts and blouses or other clothing. In such areas the cost for labor, if carbon paper were to be used, would be uneconomically excessive, the legibility would be poor, and the low-quality copies produced therefrom undoubtedly could later smear on the fabric.

Other techniques of producing multiple copies have been devised for improving upon the carbon paper technique. The xerographic process is one such method. However, the initial capital outlay involved is quite large. Also, if the size of the copies sought to be obtained is larger than a given standard size for any particular machine, cutting and pasting techniques would be necessary, which is time consuming and produces messy, inaccurate copies at an excessively high cost.

Other techniques, such as offset printing, mimeographing diazo dye and spirit duplicating have also been utilized in an attempt to find an inexpensive alternative technique of producing multiple copies of any given size of shape, which copies would be sufficiently permanent and stable for use in the pattern making industry. Of these, offset printing would require sophisticated machinery and a high degree of labor skill, which would increase its expense to prohibitive levels in an industry which deals primarily with a low-cost, high-volume item.

Spirit duplicating techniques have heretofore generally been the most successful of prior art techniques for producing multiple copies of large or irregular sizes and shapes, such as would require in pattern making. In that technique, typically a stylus was used to trace a path on the back surface of a transfer sheet having the front surface coated with a transfer coating. Along such traced path, the pressure of the stylus transferred such coating to the surface of a spirit master sheet placed below and in contact with the transfer sheet. The spirit master sheet was then separated and several spirit-moistened copy sheets were serially pressed into contact with such spirit master. When separated, the spirit-moistened copies retained on their surface a portion of the ink design created by such traced path on the spirit master. The copies then had to be dried. However, in applications such as pattern making the copies sometimes were less clear than with direct printing techniques because of the tendency of the spirit to run during imprinting after separation and prior to drying on the large sheets used.

Also, the dyes used had to be soluble in the spirit. Additionally, some spirit soluble dyes proved to be of lower tinctorial strength than certain dyes otherwise available, but which could not be used because of their nonsolubility in the spirits required. Further, because of the spirit solubility requirements, the dye system utilized had to be applied to the spirit master in a dry or solid state. In order to accomplish this, resin binders were often necessary, which increased the cost of the transfer ink coating in such application areas as pattern making.

SUMMARY OF THE INVENTION

Accordingly, in view of the shortcomings of the prior art in certain application areas, it is an object of the present invention to provide a transfer ink coating wherein no spirits are required for making copy prints.

It is an additional object of the present invention to provide a transfer ink coating wherein no resin binders are required.

It is also an object of the present invention to provide a transfer ink coating wherein all ingredients are readily available and relatively inexpensive.

It is a further object of the present invention to provide a low-cost transfer ink coating incorporating dyes of higher tinctorial strength than have heretofore been possible with prior art systems.

It is a further additional object of the present invention to provide a transfer ink coating which may be produced without special equipment and without the necessity for difficult or time-consuming steps and/or physical conditions.

These and other advantages and objects of the present invention will become apparent in view of the following specification setting forth in greater detail the preferred embodiments of the present invention.

DETAILED DESCRIPTION OF PREFERRED EMBODIMENTS

A transfer coating in accordance with a preferred embodiment of the present invention comprises a semi-dry, sponge-like coating system of high tinctorial strength. A master copy from such transfer coating will produce well in excess of twenty-five quality prints. The need for spirits and/or resin binders is eliminated. All necessary ingredients are readily available and relatively inexpensive. Conventional copy paper, which requires no treating or special coating of any kind, is used. Furthermore, in the preferred method of making such transfer ink coatings, no difficult, time consuming, or costly processing is required. These novel characteristics and advantages result from the use of the low-cost transfer ink coating in accordance with the present invention, which coating comprises a polyhydroxy alcohol, a non-drying oil, a wax, a kaoline-type clay, and a dye.

Figure 1:
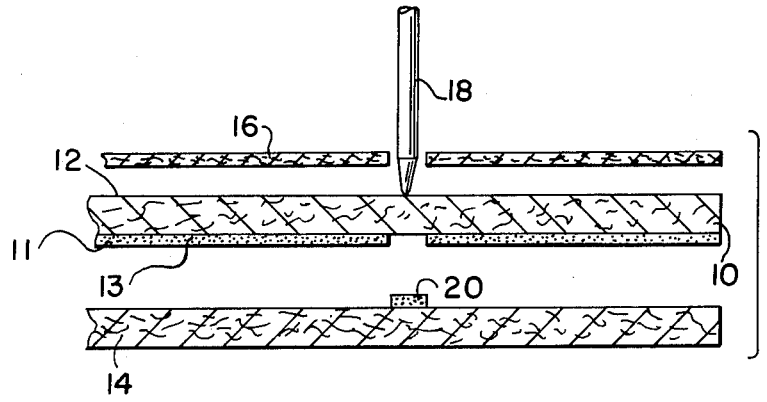
FIG. 1 represents a diagrammatic, cross-sectional view of the production of a master sheet, showing a transfer sheet and a master sheet in exploded, spaced relation, to thereby illustrate the transfer of the coating from a transfer sheet to a master sheet by means of stylus pressure applied to the non-coated side of such transfer sheet.

Referring now to the drawing and particularly to FIG. 1, a transfer sheet 10 having a coated side 11 and an uncoated side 12 has a transfer ink coating 13 on coated side 11 thereof. Coated side 11 of transfer sheet 10 is placed into contacting relation with a master sheet 14. A stencil 16 bearing the particular design desired in the final copies is overlaid on uncoated side 12 of transfer sheet 10. Localized pressure is then applied to uncoated side 12, for example by means of stylus 18 to trace the design contained on stencil 16, thereby to effect a transfer of a design portion 20 of such coating from transfer sheet 10 to master sheet 14. The completed master sheet thus produced is then peeled away from transfer sheet 10 and is subsequently used in making multiple copies therefrom.

Figure 2:
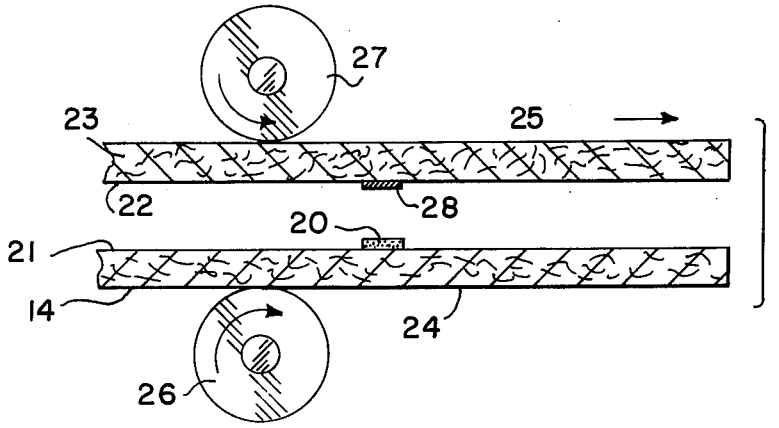
FIG. 2 is a diagrammatic cross-sectional view of the production of a copy from the master produced as in FIG. 1, showing in exploded, spaced relation transfer of a portion of the transfer ink coating from the master sheet to the copy sheet.

The production of one such copy from master sheet 14 is diagrammatically depicted in FIG. 2. The inner surface 21 of master sheet 14, bearing the design portion 20, previously transferred thereto by means of the localized pressure of stylus 18, is placed into contacting relation with the inner surface 22 of a copy sheet 23. In preferred embodiments of coating systems in accordance with the present invention, copy sheet 23 need have no special coating or processing in order to obtain a quality print thereon. Generalized pressure is applied either to the outer surface 24 of master sheet 14 or to the outer surface 25 of copy sheet 23, or to both, as for example by rollers 26, 27. Such generalized pressure over the entire outer surfaces of the master sheetcopy sheet laminate effects a transfer of a printed portion 28 of such design portion 20 onto the inner surface 22 of copy sheet 23. The copy sheet 23 may then be removed from the master sheet 14 and another copy sheet applied thereto for production of the next copy. Further copies may be produced from a given master sheet as long as enough of such design portion 20 remains on the master for transfer. In practice, more than twenty-five quality prints have been produced from a single master.

The design produced by the method herein disclosed is the mirror image of the design on the stencil used. However, that is of no moment in pattern making, because for garments requiring image/mirror image fabric pieces the paper used for the production of copy prints is sufficiently transparent to permit the image to show through upon turning such pattern over to produce a mirror image fabric piece. Alternatively and more efficiently, where fabric width will permit, such image/mirror image fabric pieces may be simultaneously produced simply by folding the fabric goods used, overlaying and pinning the pattern to a surface thereof, and then cutting both the image and the mirror image piece simultaneously.

The following examples are given as illustrations of compositions and methods suitable for the production of transfer ink coatings useable on transfer sheets from which master sheets of the type described herein may be produced.

EXAMPLE 1

This example illustrates the production of a preferred embodiment of a low-cost transfer ink coating system.

| Ingredients | Optimum Proportion (Per cent by Weight) | | Useful Proportion (Per cent by Weight) |
|---|---|---|---|
| Propylene Glycol | 13.7% | | 5–20% |
| #1 Castor Oil | 29.3% | | 20–35% |
| Carnauba Wax | 27.7% | | 20–35% |
| Clay | 14.6% | | 10–20% |
| Methyl Violet Base | 14.7% | | 10–20% |
| | 100.0% | totaling | 100% |

The propylene glycol, castor oil and carnauba wax were introduced into a steam-jacketed stainless steel kettle and agitated while heating. Heating was maintained to 180° F and stirring continued until the mixture was completely fluid.

The clay was added and heating continued until the temperature again reached 180° F. The mixture was then further stirred for 15 minutes. The methyl violet base was slowly sifted into the mixture while maintaining the temperature at 180° F. Stirring was maintained until the methyl violet base was completely wetted out.

While further maintaining the temperature at 180° F, the mixture was transferred to a ball mill and ground until the particle diameter was 0.0002 to 0.0004 inches. The resulting ground structure was then coated onto paper stock at a coating weight of 2.80 to 3.00 grams per square foot. Master sheets produced from such coated transfer sheets yielded more than twenty-five quality copies.

EXAMPLE 2

The procedure of Example 1 is carried out using mineral oil, rather than castor oil. Twenty five copies of good quality are produced from a single master sheet.

EXAMPLE 3

The procedure of Example 1 is carried out using ethylene glycol rather than propylene glycol. The multiple copies produced therefrom are of high quality.

EXAMPLE 4

The procedure of Example 1 is repeated using Victoria blue dye, rather than methyl violet base. The tinctorial strength of the dye is sufficient to provide good copies.

EXAMPLE 5

The procedure of Example 1 is repeated using Nigrosine Base NB dye, rather than methyl violet base. The tinctorial strength of the dye is sufficient to provide good copies.

EXAMPLE 6

The procedure of Example 1 is carried out using microcrystalline wax (Bareco WB-7), rather than carnauba wax. Twenty five copies are made from a single master sheet, all of which are of good quality.

EXAMPLE 7

The procedure of Example 1 is carried out using ouricoury wax, rather than carnauba wax. Twenty five copies of high quality are produced from a single master.

EXAMPLE 8

The procedure of Example 1 is carried out using candelilla wax, rather than carnauba wax. Twenty five copies of good quality are produced from a single master.

EXAMPLE 9

The procedure of Example 1 is carried out using polyethylene wax, rather than carnauba wax. Twenty five high quality copies are produced from a single master.

EXAMPLE 10

The procedure of Example 1 is carried out using paraffin wax, rather than carnauba wax. Twenty-five copies of good quality are produced from a single master sheet.

EXAMPLE 11

The procedure of Example 1 is carried out using beeswax rather than carnauba wax. Twenty-five good quality copies are produced from a single master.

EXAMPLE 12

The procedure of Example 1 is carried out using montan wax, rather than carnauba wax. Twenty-five copies of good quality are produced from a single master sheet.

The above examples are meant to be illustrative of physical embodiments of the present invention and no limitation is intended thereby.

These compositions may, of course, be widely modified in accordance with the principles and purposes of the present invention, one such purpose being to provide a transferable coating for the production of master sheets which will function in the manner of a sponge-like ink pad. The coatings contemplated by the present invention are non-drying and capable of withstanding the production of many copies therefrom.

The copy paper used need not be specially coated, no resin binders are required, and the dye used is soluble in the polyhydroxy alcohol/oil/wax solvent system. The polyhydroxy alcohol used is selected for its humectant properties and any of several such alcohols could be used, including propylene glycol, ethylene glycol, glycerine, etc.

The particular oil used may be varied as long as the viscosity and non-drying characteristics required thereof are maintained. Castor oil and mineral oil have been most effective.

A variety of waxes may be used, including preferably the hard waxes, such as carnauba, microcrystalline (Bareco WB-7), ouricoury, condelilla, polyethylene, paraffin, montan, palm, japan and others.

A wide variety of dyes may be used, including methyl violet base, Victoria blue, Nigrosine Base NB, azo-black, indulines, crystal violet, fuchsine, anthraquinone dyes, and chrysoidine and the like. However, the dyes used must be soluble in the solvent system employed.

Other modifications, substitutions and alternatives will be readily apparent to one skilled in the art upon a review of the present disclosure and are intended to be included within the scope of the present invention.

What is claimed is:

1. A process for producing a transfer sheet having a transferable coating on said transfer sheet, said transfer sheet for use in producing master sheets by localized, patterned pressure against said transfer sheet, from which master sheets multiple copies may be made by pressure against the surface thereof, said process comprising:

agitating a mixture of polyhydroxy alcohol, a non-drying oil, and a wax;

heating to and maintaining said agitating mixture at approximately 180°, whereby said agitating mixture is rendered completely in the liquid state;

adding a kaolinite clay to said agitating mixture;

maintaining agitation thereof for at least approximately 15 minutes;

slowly sifting a dye soluble therein into said agitating mixture;

further agitating said mixture until said soluble dye has completely dissolved in said mixture;

grinding said mixture to a particle diameter size of between approximately 0.0002 and 0.0004 inches; and coating said mixture on said transfer sheet surface.

2. The method as claimed in claim 1 wherein:

said mixture is coated onto a transfer sheet surface at a coating weight of between approximately 2.80 and 3.00 grams per square foot.

* * * * *